United States Patent [19]

Chazelas

[11] 4,425,111

[45] Jan. 10, 1984

[54] METHOD AND MACHINE FOR MANUFACTURING A MULTIPLICITY OF LINKED FILING POCKETS

[76] Inventor: Andre Chazelas, 78250 Meulan, Oinville, France

[21] Appl. No.: 244,726

[22] Filed: Mar. 17, 1981

[30] Foreign Application Priority Data

Mar. 31, 1980 [FR] France ..... 80 07140

[51] Int. Cl.[3] ..... B31D 3/02

[52] U.S. Cl. ..... 493/918; 270/37; 493/210; 493/447; 493/947; 493/940; 493/90; 493/448

[58] Field of Search ..... 493/231, 262, 264, 267, 493/225, 447, 448, 451, 463, 334, 335, 918, 940, 90, 210, 947, 966; 226/1.5 R; 206/44 B; 270/32, 37

[56] References Cited

U.S. PATENT DOCUMENTS 1,968,165 7/1934 Olm ..... 493/918 X
2,677,993 5/1954 Ens .
2,696,768 12/1954 Mickey ..... 493/940 X
3,434,400 3/1969 Hochfeld ..... 493/447 X

*Primary Examiner*—A. J. Heinz
*Attorney, Agent, or Firm*—Charles E. Brown

[57] ABSTRACT

The invention concerns expanding files. A flat strip of flexible material (12) is progressively folded longitudinally to form a U-shaped channel. A length of the material equivalent to the developed width of a gusset is drawn forward. A precut partition with glued tabs (113) is placed at the rear of the drawn forward section of material. A fold is formed by pushing the three edges of the channel inwardly. This sequence of operations is repeated to form a multiplicity of pockets, comprising a plurality of parallel partitions joined along three edges to constitute respective filing pockets by the flexible material which is concertina-folded to constitute respective gussets. This multiplicity of pockets may be sectioned to provide separate expanding files. The invention comprises the manufacturing method and the machine for implementing same.

22 Claims, 16 Drawing Figures

METHOD AND MACHINE FOR MANUFACTURING A MULTIPLICITY OF LINKED FILING POCKETS

BACKGROUND OF THE INVENTION

1. Field of the Invention

The present invention concerns a method and machine for manufacturing a multiplicity of linked pockets for making up expanding files comprising a plurality of partitions joined along three edges to constitute respective filing pockets by a flexible material concertina-folded to constitute respective gussets.

2. Description of the Prior Art

Files comprising a plurality of parallel partitions joined along the edges to constitute respective filing pockets by a flexible material concertina-folded to constitute respective gussets are known in the art.

Such files are usually manufactured one at a time using manual methods, involving various operations to form the concertina folds and to prepare and place the partitions in the folds, and various finishing operations.

This type of manufacturing method is highly labor intensive and calls for skilled labor. The resulting expanding files are expensive. The rate of manufacture is also low, and is often insufficient to meet demand.

The present invention is intended to overcome the aforementioned disadvantage by proposing a method of manufacturing a multiplicity of linked pockets for making up expanding files and a machine for implementing that method, whereby high rates of manufacture are obtained with less labor and the product is of excellent finish.

The invention consists in a method for manufacturing a multiplicity of linked pockets for making up expanding files comprising a plurality of parallel partitions joined along three edges to constitute respective filing pockets by a flexible material concertina-folded to constitute respective gussets, characterised in that a flat strip of the flexible material is progressively folded longitudinally to form a substantially U-shaped channel, a length of the material equivalent to the developed width of a gusset is drawn forward, a precut partition with folded and glued tabs on at least two sides is placed at the rear of the drawn forward section of material, perpendicular to the longitudinal axis thereof, a fold is formed centrally of said drawn forward section of material by pushing the three edges of the channel inwardly, the fold thus formed is compressed in the longitudinal direction to bond said partition, and a new length of material is drawn forward, this sequence of operations being repeated to form a multiplicity of pockets.

The invention further consists in a machine for manufacturing a multiplicity of linked pockets for making up expanding files comprising a plurality of parallel partitions joined along three edges to constitute respective filing pockets by a flexible material concertina-folded to constitute respective gussets, characterised in that it comprises, from the rear towards the front: a spool of the flexible material, a member shaped to progressively fold the material into a substantially U-shaped channel, means for drawing forward a length of the material equivalent to the developed width of a gusset, means disposed around the three sides of the U-shaped channel to form respective gussets by exerting a pushing action by virtue of a movement substantially perpendicular to the longitudinal axis of the material, means for compressing the gussets thus formed, retractable means for restraining the multiplicity of pockets previously formed during the formation of each gusset, and means for braking the forward motion of the multiplicity of pockets.

According to another feature of the invention, partition feed means are disposed above the position of the drawn forward section of material, comprising a plate movable between a substantially horizontal position in which it receives a partition with folded and glued tabs and a substantially vertical position in which it is positioned, with the partition, at the rear of the drawn forward section of material. The surface of the plate receiving the partition is connected to suction means for retaining the partition during its transfer.

According to another feature of the invention, at the front of the machine are means for restraining and sectioning the multiplicity of linked pockets, comprising a frame movable vertically and adapted to engage in a gusset to permit the multiplicity of linked pockets to be sectioned by means of a cutting tool.

A machine in accordance with the invention has undeniable advantages as compared with the prior art. It provides for the continuous automatic manufacture with little human intervention of linked pockets for making up expanding files comprising a plurality of parallel partitions joined to constitute respective filing pockets.

The prior art problem of productivity is overcome by the automatic operation of the machine, resulting in high manufacturing rates. The cost of manufacturing files from linked pockets produced by the method in accordance with the invention is substantially lower than is the case for prior art files of the same type, due in part to the increased production rate and in part to the reduced labor requirement. Another significant advantage is that the folds of the gussets are formed mechanically, and are therefore perfectly regular to confer an excellent finish.

Further objects and advantages will appear from the following description of an example of the invention, when considered in connection with the accompanying drawings, and the novel features will be particularly pointed out in the appended claims.

DESCRIPTION OF THE PREFERRED EMBODIMENT

Figure 1:
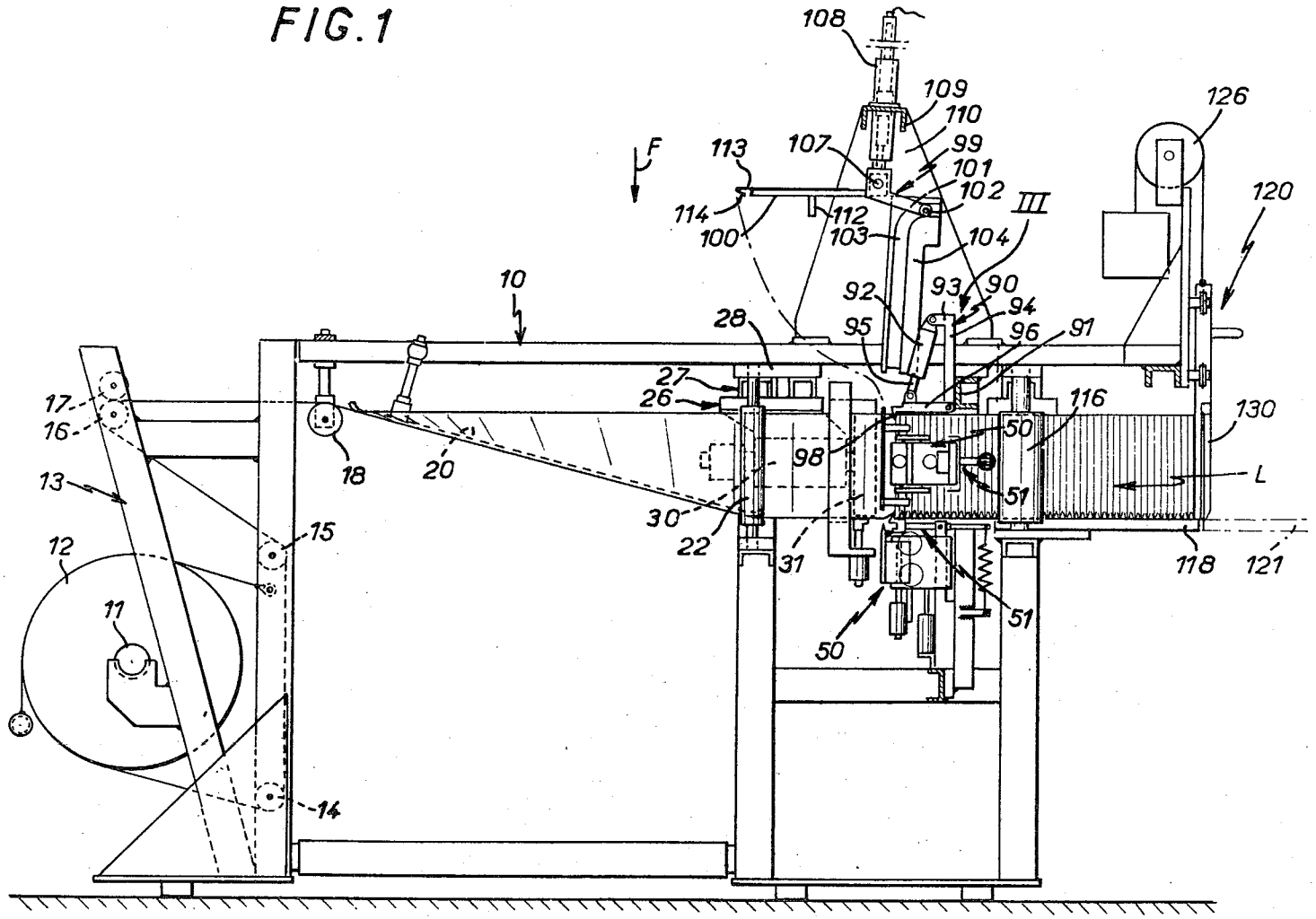
FIG. 1 is a side elevational view of a machine in accordance with the invention.
Figure 2:
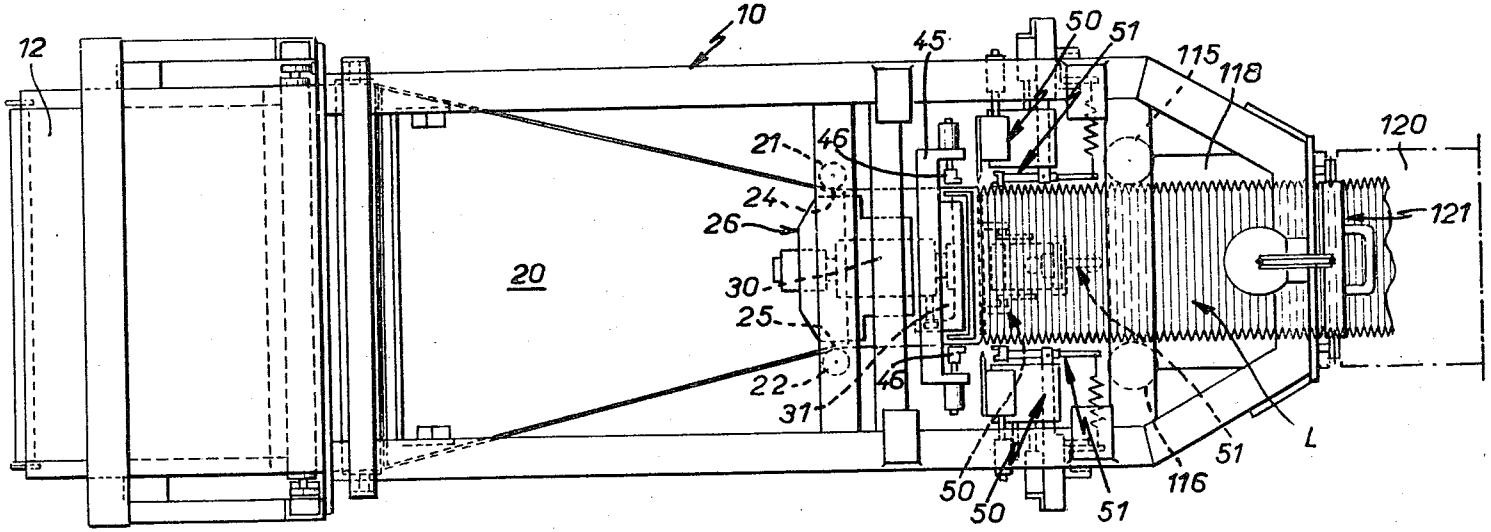
FIG. 2 is a plan view of the machine, seen along arrow F in FIG. 1.
Figure 3:
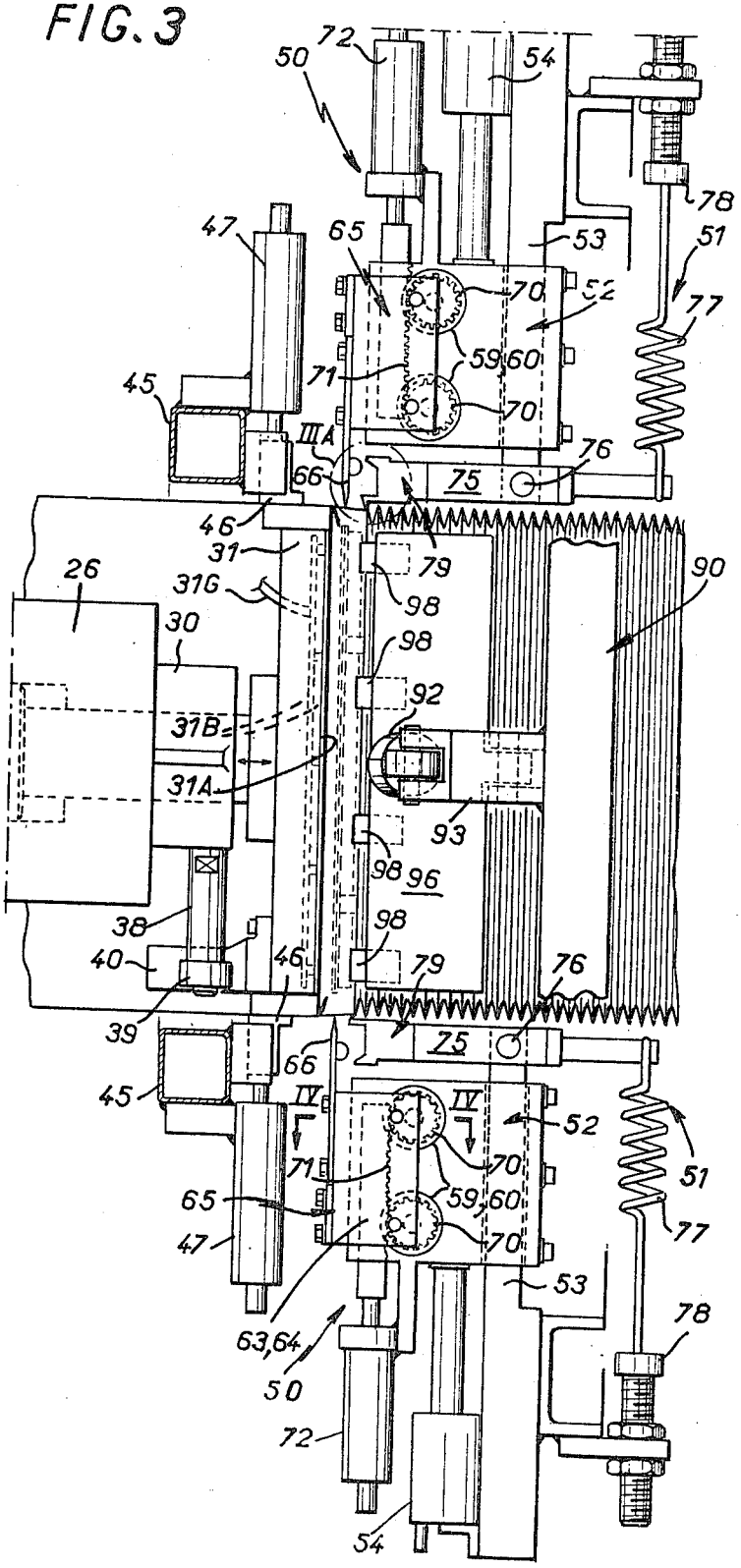
FIG. 3 is an enlarged fragmentary plan view of that part of the machine indicated by the arrow III in FIG. 1, the partition feed means not being shown in this Figure.

Referring to FIGS. 1 to 3, the machine in accordance with the invention comprises a frame 10 at the rear of which is a spool 11 carrying a roll of, for example, linen-reinforced paper 12. The spool 11 rotates on a frame 13 and the paper 12 is fed round guide rollers 14 to 18 to the upper part of the rear of the machine frame 10.

As it moves beyond roller 18 the paper 12 is gradually folded longitudinally to form a U-shaped channel, by means of an appropriately shaped member 20 mounted on the frame and extending from roller 18 to two rollers 21, 22 which rotate about vertical axes and press the sides of the U-shaped channel against the vertical faces of the aforementioned member 20.

A block 26 is suspended from frame 10 by attachment means 27 which slide in a support 28 fixed to frame 10. Block 26 houses a piston-and-cylinder actuator 30, the piston rod of which carries a substantially rectangular plate 31, the front surface 31A of which is connected by passages 31B and conduit 31C to suction means (not shown). The height and width of plate 31 are substantially equivalent to those of the U-shaped cross-section of the folded paper. Plate 31 is coupled to actuator 30 and moves longitudinally between respective advanced and retracted positions. The travel of plate 31 is adjusted as appropriate to the length of paper to be drawn off the spool by virtue of the sliding relationship of attachment means 27 and support 28 (FIG. 1).

To prevent actuator 30 rotating about its axis in block 26, its cylinder is fitted with a radial extension arm 38 (FIG. 3) the end of which carries a roller 39 engaging a forked member 40 attached to the rear surface of plate 31.

Plate 31 has two functions: to compress each gusset formed in the paper and to simultaneously draw the folded paper forward over a distance corresponding to the developed width of a gusset.

The folded paper is drawn forward by gripping means substantially aligned with plate 31 and extending along the three sides of the U-shape formed by the folded paper.

These gripping means (FIGS. 1 and 3) comprise a frame 45 surrounding the folded paper. One side of this frame is attached to the top edge of plate 31 so that frame 45 and plate 31 move together. The remaining three sides of the frame carry respective pressing devices consisting of a bar 46 facing the respective edge of plate 31 and coupled to a small piston-and-cylinder actuator 47 attached to the frame.

It will be understood that when these actuators are pressurised the corresponding bars are moved towards the corresponding edge of plate 31 to grip the paper which is located between said bars and the sides of plate 31.

Slightly forward of plate 31, frame 10 carries to each of the three sides of the U-shaped folded paper folder means 50 for forming a gusset from the length of paper drawn forward, and means 51 for restraining the bundle thus formed.

The three folder units 50 arranged to form one gusset are of similar construction. Thus only one of these units will be described hereinafter.

Figure 4:
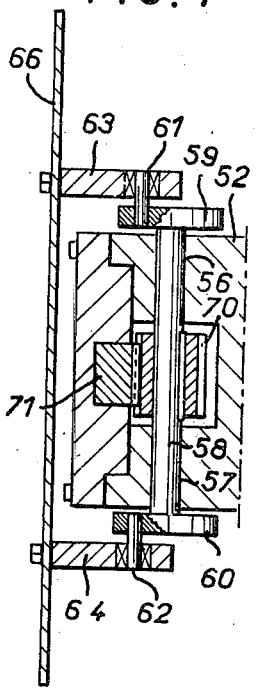
FIG. 4 is a fragmentary vertical sectional view taken on line IV—IV in FIG. 3.

Each folder unit 50 comprises a first carriage 52 which is moved perpendicularly to the axis of the folded paper on a fixed slide 53 by a piston-and-cylinder actuator 54 to which this carriage is coupled. The first carriage 52 is shaped to form bearings 56 and 57 for a spindle 58, as shown particularly clearly in FIG. 4. The ends of the spindle projecting beyond the first carriage are coupled to disks 59, 60 which are in turn coupled to pins 61, 62 keyed to arms 63, 64 constituting a second carriage 65 supporting a folding plate 66. Substantially centrally located on spindle 58 is a pinion 70 engaging a rack 71 which is moved longitudinally by an associated piston-and-cylinder actuator 72.

As is clearly seen in FIG. 3, each folder unit 50 for forming the gussets has two such spindle/pinion/pin assemblies driven by a common rack.

The folder blade 66 mounted on each folder unit has a forward edge 66A parallel to the respective side of the U-shaped folded paper.

Note that the folder unit disposed opposite the base of the U-shape formed by the folded paper carries a folder blade which extends at least the full length of said base, whereas the folder blades of the folder units disposed opposite the sides of the U-shape are slightly shorter than those sides. They are so arranged that their respective lower ends are spaced a short distance from the base of the U-shape. This arrangement is required to permit the simultaneous formation of a gusset in each of the three sides of the U-shape.

Figure 3A:
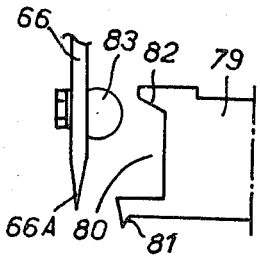
FIG. 3A is a view plan to a still larger scale of that part of the machine of FIG. 3 indicated as an area IIIA.

Referring to FIG. 3, like the folder means for forming the gussets, the restraining means 51 are located in the immediate vicinity of the sides of the folded paper. The three units are of similar construction, so that only one will be described hereinafter. Each restraining unit comprises a stirrup-shaped lever 75 disposed opposite one side of the paper, pivotting on a spindle 76 attached to the end of slide 53. Lever 75 extends on both sides of this spindle and is connected at its front end to a return spring 77 associated with a tension adjusting device 78 attached to the fixed slide 53. Its opposite end is fitted with a restraining head 79. The end face of this restraining head (FIG. 3A) features a central cut-out 80 to each side of which is one or more claws 81 designed to engage the edge of a gusset and a ramp surface 82 designed to cooperate with a cam 83 attached to the folder blade 66. The purpose of this arrangement will be described later when the operation of the machine is described.

A complementary restraining unit 90 (FIG. 1) is arranged to engage the upper edge of the last partition fitted. This restraining unit is supported on a cross-member 21 attached to the frame. It comprises a piston-and-cylinder actuator 92 the cylinder of which is pivotted to a cross-beam 93 at the upper end of a vertical arm 94 attached to the cross-member. The piston rod 95 of actuator 92 is coupled to a lever 96 pivotted at one end to the aforementioned vertical arm and with at least one claw 98 at its other end.

The aforementioned claw 98 and the claws 81 on restraining units 51 may each consist of a single continuous member extending over the greater part of the sides of the U-shape and the upper edge of a partition, or alternatively of a row of spaced separate members disposed along the ends of levers 75 and 96.

Above the area in which a gusset is formed by folding the paper, beyond the open side of the U-shape into which the paper is folded, frame 10 supports a partition feed device 99. Referring to FIG. 1, this device comprises a plate 100 extended in the forward direction by an arm 101 supporting a roller 102 engaging a ramp surface 103 on a vertical arm 104.

Plate 100 is coupled by means of a spindle 107 to the piston rod of a piston-and-cylinder actuator 108 supported on a cross-member 109 attached to flanges 110 attached to the frame.

The surface of plate 100 designed to carry a partition 113 is connected by conduit 112 to suction means (not shown). The plate is designed to transfer a partition 113 from a substantially horizontal position in which it is disposed on the plate to a substantially vertical position to the rear of the drawn forward length of paper equivalent to the developed width of a gusset, as will be described in more detail later.

Figure 10:
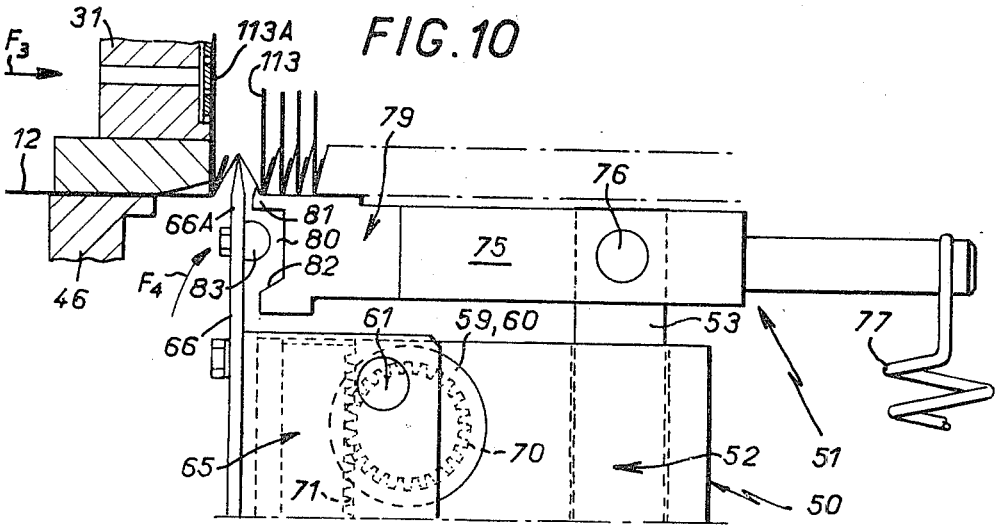
Figure 13:
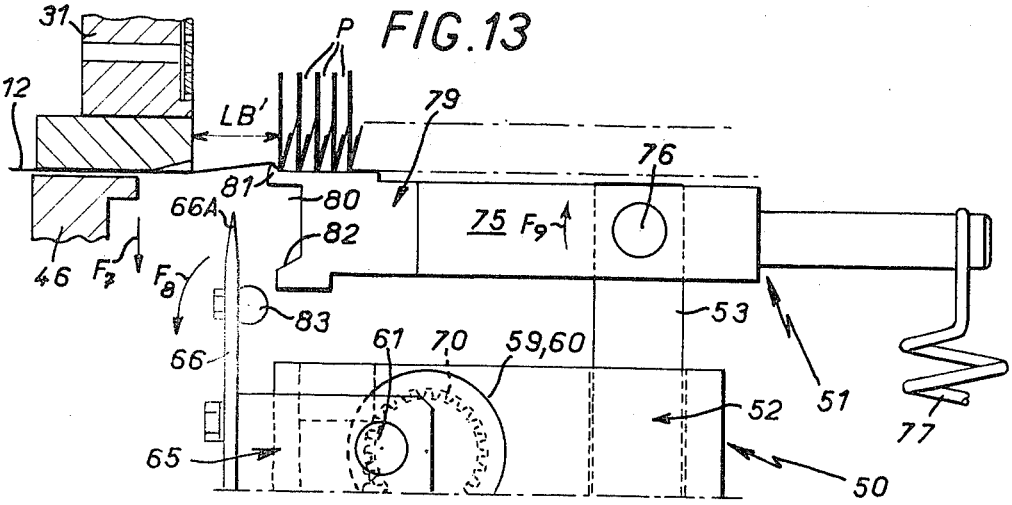

The partition 113 has folded and glued tabs 114 on three edges, and is disposed on plate 100 so that after a gusset is formed the tabs are disposed opposite the rear surface of the gusset, as is shown particularly clearly in FIGS. 10 and 13. These tabs are shaped to match the vertical and horizontal bottom edge portions of the gusset.

A short distance forward of the restraining and folding means frame 10 carries two pressure rollers 115, 116 (FIGS. 1 and 2) which rotate about vertical axes. The separation of these rollers is adjustable to exert a required braking effect on the vertical sides of the bundle L which rests on a support table 118.

At the edge of the aforementioned table 118 are disposed means 120 for restraining the bundle L and for sectioning the bundle to form separate expanding files with the required number of pockets.

Figure 5:
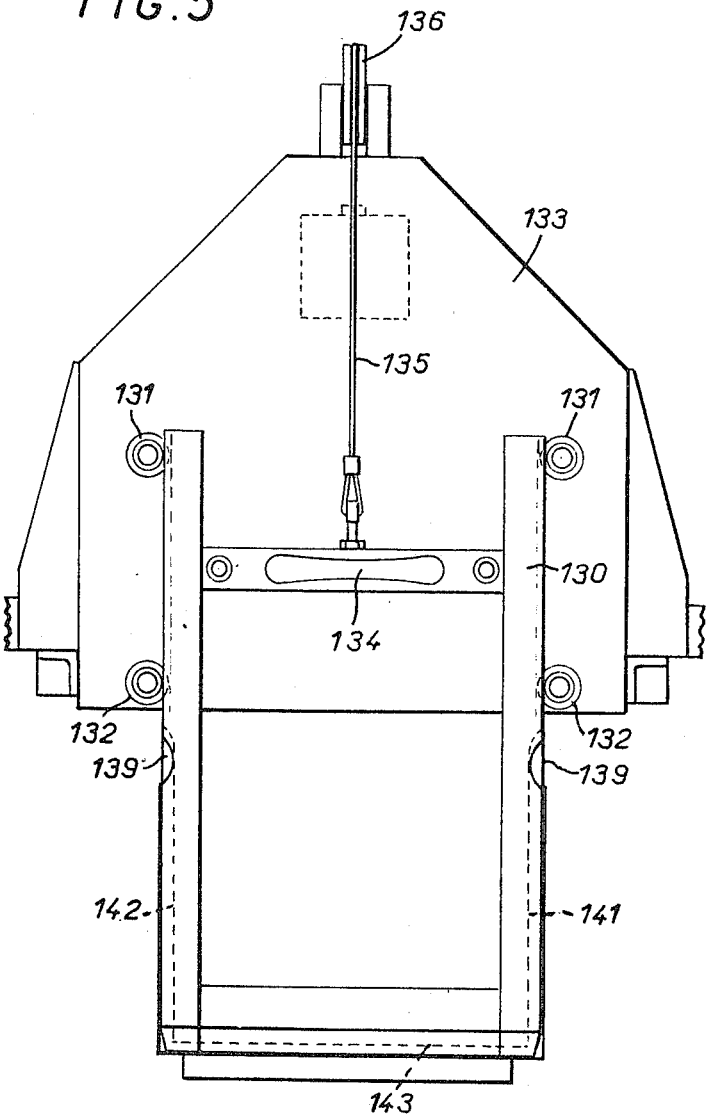
FIGS. 5, 6 and 7 are respectively elevation, side and plan views (partially cut away) of the means for sectioning the multiplicity of linked pockets.
Figure 6:
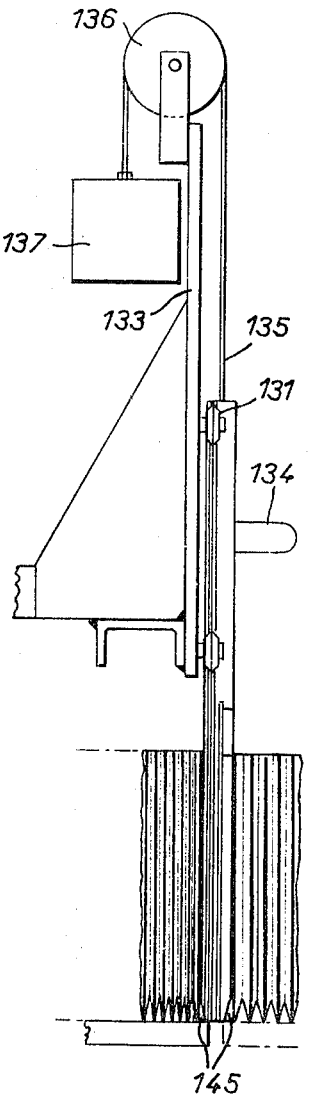
Figure 7:
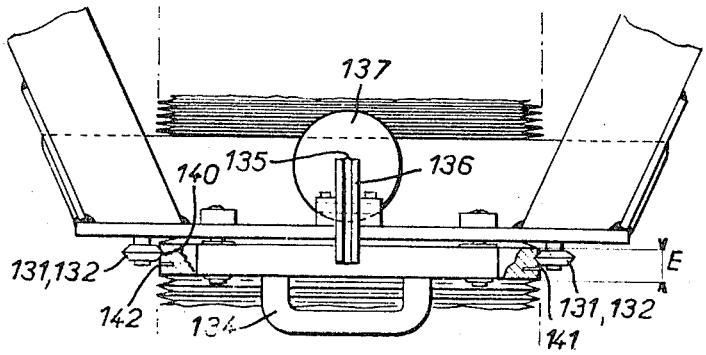

Referring to FIGS. 5 to 7, the restraining and sectioning means basically comprise a frame 130 which moves vertically between two pairs of guide rollers 131, 132 mounted on a supporting framework 133 attached to the frame of the machine. On the front surface of frame 130 is a handle 134. Frame 130 is connected by a cable 135 passing over a pulley 136 to a counterweight 137. The sides of uprights of frame 130 are formed with grooves in which guide rollers 131, 132 run. In the central area of these sides of frame 130 are cut-outs 139 from which slots 141, 142 extend downwards, parallel to grooves 140. The bottom edge of the frame is formed with a similar slot 143.

The front and rear surfaces of the bottom edge of the frame are chamferred, as shown at 145, to facilitate the insertion of the frame between consecutive partitions (in other words, into a pocket). The thickness E of frame 130 (FIG. 7) is such as to open out a gusset to facilitate a transverse cut effected manually by means of a cutting blade guided by the aforementioned slots 141 to 143 in the frame.

OPERATION

The formation of a gusset will now be described with particular reference to FIGS. 8 to 13, which show the formation of a gusset in the base of the U-shape into which the paper is folded. It will be understood that the vertical gussets are formed simultaneously and by the same method.

Figure 8:
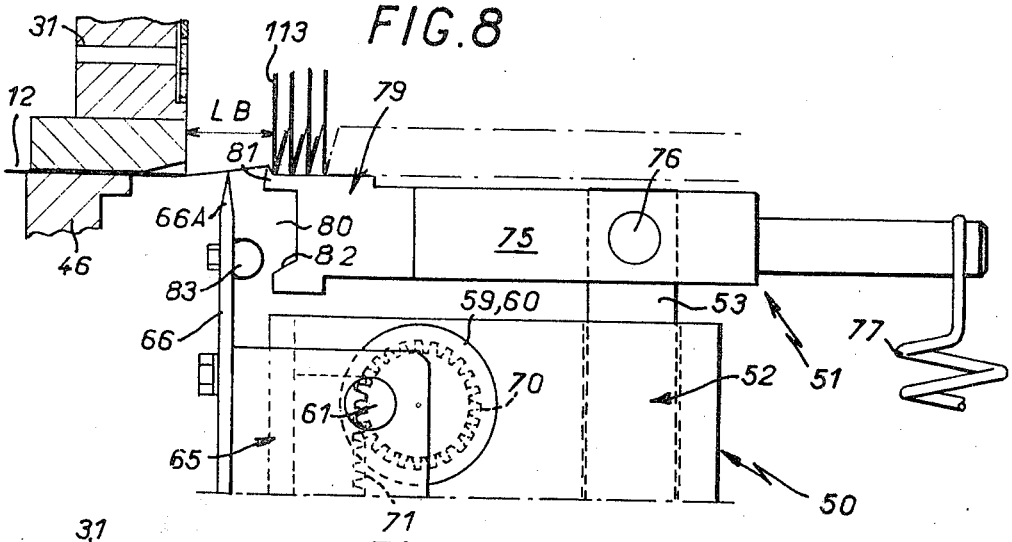
FIGS. 8 to 13 show various stages in forming a gusset.

Referring to FIG. 8, the restraining means 51 to the sides of and below the U-shape folded paper 12 are in the active position, as is the upper restraining unit 96, so that the last partition 113 is restrained by the claws of all units, along its four edges. Note that the aforementioned restraining means are activated by springs 77 and tension adjusters 78. Plate 31 is in the retracted position with gripping means 46 in the active position, pressing the paper 12 against plate 31. The folder blades 66 of the folder units are in an intermediate position, and a length "LB" of paper extends between the last partition 113 and the front surface of plate 31. "LB" is equal to the developed width of a gusset.

Figure 9:
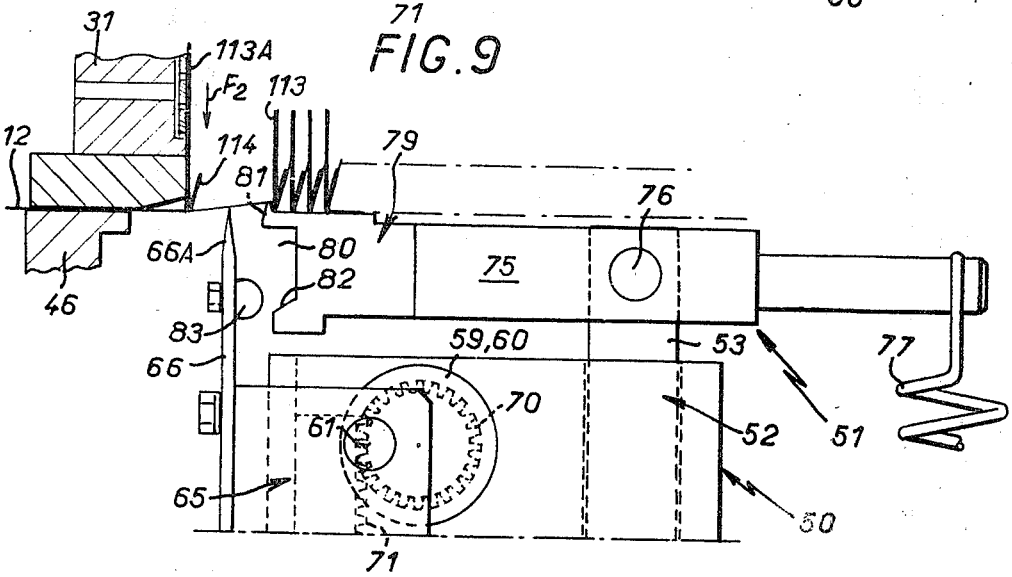

Referring to FIG. 9, the partition feed plate 100 has operated to insert a partition 113A (arrow F2) in front of the front surface of plate 31, at the rear of the aforementioned length of paper. Partition 113A is held against plate 31 by virtue of the connection of its front surface 31A via conduits 31B, 31C to suction means. Note that tabs 114 parallel to the vertical and horizontal bottom edges of the U-shape folded paper are directed towards the front.

Referring to FIG. 10, plate 31 is moved forward (arrow F3) and at the same time the folder blades of folder units 50 are moved simultaneously by means of the associated second carriages 65 and actuators 72. Blades 66 thus move from a standby position to an advanced position, moving towards respective sides of the U-shape, substantially at the mid-point of length "LB".

As second carriages 65 are attached to pins 61, the second carriages and thus blades 66 move in a path which is substantially a circular arc (arrow F4), rather than a straight line, so that cams 83 enter cut-outs 80 and the folder blades move towards the front of plate 31.

Figure 11:
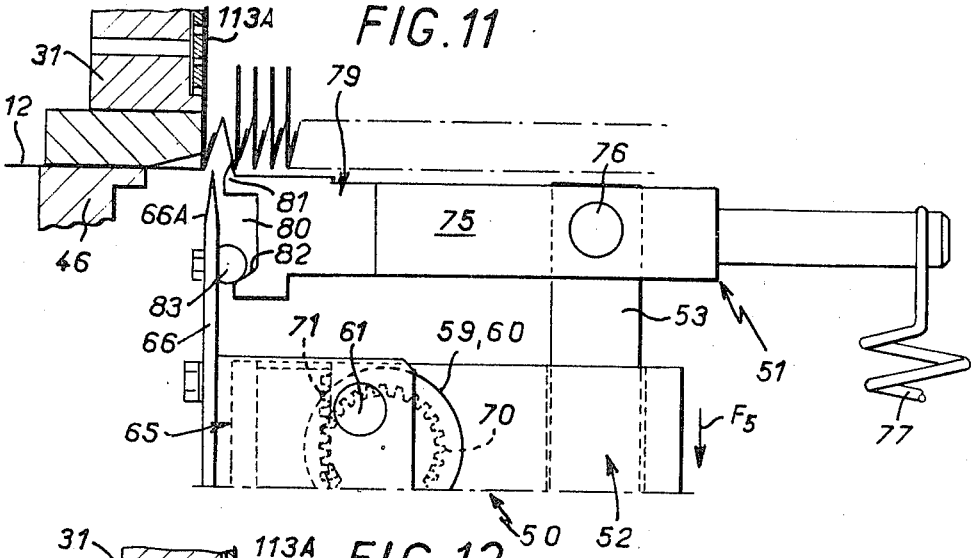

Referring to FIG. 11, as plate 31 continues its forward movement it begins to compress the gusset which has just been formed so as to bond the tabs to the corresponding surfaces of the gusset, the first carriages 52 being moved (arrow F5) by pressurising associated actuators 64 so that folder blades 66 move from the advanced position to a retracted position. Actuators 72 associated with second carriages 65 are maintained under pressure to maintain the folder blades in a position identical to that shown in FIG. 10, in which cam 83 is engaged in cut-out 80. The movement of the first carriages disengages folder blades 66 from the gusset formed and brings cam 83 into contact with ramp surface 82 of restraining means 51 and pivotting lever 75 (arrow F6) around spindle 76 from its active position (FIGS. 8 to 11) to a retracted position (FIG. 12).

Simultaneously with retraction of levers 75, lever 96 of the upper restraining unit 90 is retracted by actuator 92, so that the the four edges of the U-shape folded paper are released for subsequent pressing.

Figure 12:
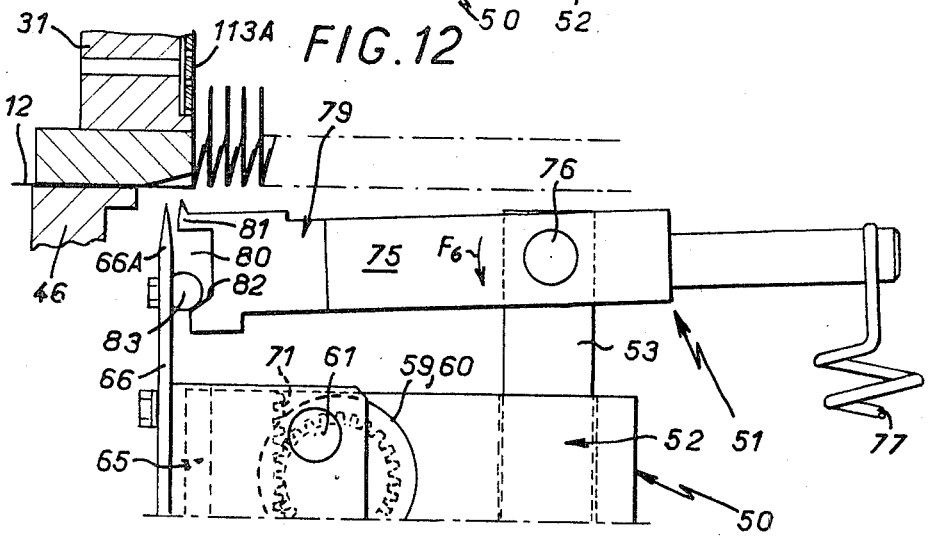

Referring to FIG. 12, plate 31 moves to its extreme forward position to press the tabs on partition 113A against the corresponding rear surface of the gusset which has just been formed.

Referring to FIG. 13, when the pressing operation is completed, the pressing means 46 are released (arrow F7) and plate 31 is retracted to its initial (standby) position. As plate 31 begins to move to the rear, second carriages 65 are retracted (arrow F8) so that blades 66 face a new length "LB'" of paper, being located substantially at the mid-point of said length.

As the second carriages begin to move to their retracted position, cams 83 release levers 75 which are automatically returned to the active position (arrow F9) by springs 77, in which position claws 81 restrain the last gusset formed.

Note that the new length "LB'" is drawn forward simultaneously with the formation of the gusset since the three edges of the folded paper are drawn forward simultaneously by the forward movement of plate 31 by virtue of gripping means 46 which temporarily clamp the paper to plate 31 (FIGS. 8 to 12), whereas at the end of the pressing operation, prior to rearward movement of plate 31, gripping means 46 are disabled. The gripping means are in the active position at all times except during the rearward movement of plate 31.

Figure 15:
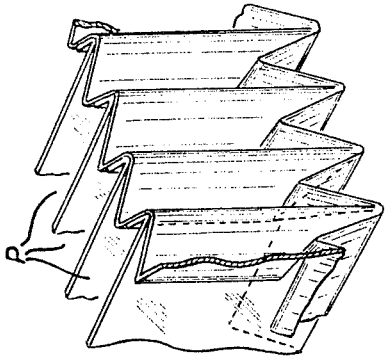
FIG. 15 is an enlarged fragmentary perspective view of that part of FIG. 14 indicated as an area XV and shows the details of a few concertina folds.
Figure 14:
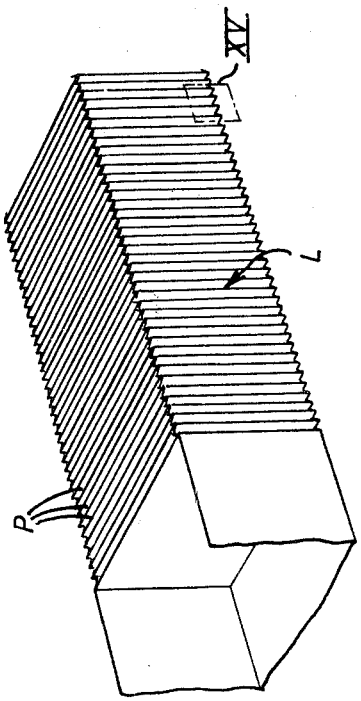
FIG. 14 is a perspective view of a multiplicity of linked pockets produced by the method in accordance with the invention, suitable for making up expanding files comprising a plurality of filing pockets.

The above operations are repeated to form bundle L comprising a multiplicity of pockets P, as shown particularly clearly in FIGS. 14 and 15.

Referring to FIG. 15, the folder blade of the folder unit disposed opposite the base of the U-shape into which the paper is folded forms a fold which extends along the entire length of this base, whereas the folder blades of the folder units facing the sides of the U-shape are of a length such that they terminate at the level of the crest of the fold in the base of the U-shape.

Forward of the gusset-forming area the multiplicity of linked pockets is guided and gently braked by pressure rollers 115, 116, so that the gussets are compressed in the area between the gusset-forming area and the pressure rollers. This ensures good bonding of the partitions.

The front end of frame 10 is advantageously fitted with means for restraining the bundle L thus formed, and for sectioning the bundle to constitute separate expanding files with the required number of pockets.

Frame 130 is normally in the lowered position to form an end-stop at the front end of bundle L. To section the bundle, frame 130 is raised by means of handle 134 to release the required number of gussets and partitions (ie. pockets). This operation is effected manually. When the appropriate number of pockets has been released, frame 130 is lowered into a pocket between consecutive partitions. These partitions are held apart manually to facilitate insertion of frame 130, which is lowered until it abutts the table through the bottom of the pocket. The thickness of the frame is such that the gusset in question is fully opened out, the cut then being made by means of a blade guided in slots 141, 142, 143 so that the gusset is cut centrally on all three sides, the aforementioned slots being centrally located in the front-to-back dimension of the frame.

The expanding file thus obtained, with the required number of pockets, rests on a table 121 forming an extension of table 118. It is then removed and a new cut made, as the machine continues to form further gussets.

It will be understood that various changes in the details, materials and arrangements of parts, which have been herein described and illustrated in order to explain the nature of the invention, may be made by those skilled in the art within the principle and scope of the invention as expressed in the appended claims.

I claim:

1. A method for manufacturing a multiplicity of linked pockets for making up expanding files of the type comprising parallel partitions and pleated flexible material joining the partitions along three sides thereof, said method comprising the steps of: (a) providing precut partitions with folded tabs along at least two sides, and the folded tabs having glue thereon; (b) providing a flat web of flexible material; (c) gradually longitudinally folding the web of flexible material into a substantially U-shaped channel; (d) advancing a predetermined length of the U-shaped channel corresponding to the desired maximum unfolded distance between a pair of partitions; (e) inserting one of said partitions at the rear of the advanced length of the U-shaped channel perpendicularly to the longitudinal axis of the channel; (f) forming a central fold along the three sides of the advanced length inwardly of the corresponding edges of the partition; (g) longitudinally compressing the central fold thus formed to bond the partition folded tabs to the corresponding folded material; and (h) repeating steps (d) through (g) to form a multiplicity of linked pockets.

2. A method according to claim 1, wherein stage (d) and (f) are carried out substantially simultaneously.

3. A method according to claim 1, wherein the central fold is formed simultaneously along the three sides of the advanced length of the U-shaped channel.

4. A method according to claim 1, further comprising sectioning a predetermined multiplicity of linked pockets from other linked pockets therebehind.

5. A machine for manufacturing a multiplicity of linked pockets for making up expanding files having a plurality of parallel partitions with folded and glue carrying tabs along at least two sides thereof and pleated flexible material joining consecutive partitions along three sides thereof, said machine comprising, from rear to front, means for supporting a spool of flexible material in web form, a member for gradually folding flexible material into a substantially U-shaped channel having three sides as said flexible material is moved forwardly along a path past said member, means for advancing a predetermined length of the flexible material U-shaped channel corresponding to a preselected maximum unfolded distance between a pair of adjacent partitions, means for positioning a partition at the rear of the advanced length of the flexible material U-shaped channel, means disposed along the three sides of the advanced length of the flexible material U-shaped channel for forming a central fold along the three sides of the advanced length of the flexible material U-shaped channel inwardly of the corresponding edges of adjacent ones of said partitions, means for longitudinally compressing the folded advanced length of the flexible material U-shaped channel to bond the folded and glue carrying tabs of the partition to portions of folded advanced length of the flexible material U-shaped channel, restraining means for restraining a multiplicity of linked pockets during the formation of a central fold, and means for braking forward motion of the multiplicity of linked pockets.

6. A machine according to claim 1, further comprising means for feeding individual partitions to said means for positioning a partition.

7. A machine according to claim 1, further comprising means for sectioning a multiplicity of linked pockets to constitute a separate expanding file.

8. A machine according to claim 7, wherein said means for sectioning a multiplicity of linked pockets includes a frame movable vertically between a raised position for allowing the passage of a section of linked pockets and a lowered position for restraining the linked pockets.

9. A machine according to claim 8, wherein said frame has vertical and bottom sides and lower edges, said lower edges of said frame are chamfered, said frame having a thickness substantially equal to the predetermined length of the flexible material U-shaped channel, and slots in said vertical and bottom sides of said frame for guiding a cutting tool.

10. A machine according to claim 9, wherein said frame has a front and a back, and said slots are disposed centrally between said front and back of said frame.

11. A machine according to claim 1, wherein said means for advancing a predetermined length of the flexible material U-shaped channel includes a longitudinally reciprocable plate, three edges of said plate substantially corresponding to the contour of the flexible material U-shaped channel, gripping means longitudinally movable with said reciprocable plate, said gripping means being disposed opposite said three edges of said reciprocable plate and being movable between an advanced position for gripping the flexible material between said gripping means and said reciprocable plate and for advancing the predetermined length of the flexible material U-shaped channel with the forward movement of said reciprocable plate, and a retracted position for releasing the flexible material.

12. A machine according to claim 11, wherein said reciprocable plate and said gripping means are suspended from a frame for adjustment relative to the direction of displacement of the flexible material U-shaped channel, a front surface of said reciprocable plate being connected via conduits to suction means.

13. A machine according to claim 11, wherein said reciprocable plate has thereon said means for compressing the folded length of the flexible material U-shape channel.

14. A machine according to claim 1, wherein said means for forming a central fold along three sides of the advanced length of the flexible material U-shaped channel includes three folding units each having a folder blade movable substantially perpendicularly to the path of movement of the flexible material U-shaped channel between a retracted standby position and an advanced operating position, and means for controlling the movement of each of said folder blades.

15. A machine according to claim 14, wherein said means for controlling the movement of each of said folder blades including a first carriage reciprocable along a slide perpendicular to the path of movement of the flexible material U-shaped channel, a second carriage forming a blade support, means for moving said second carriage relative to said first carriage from a retracted position to an advanced position while simultaneously moving from the rear toward the front of the machine along a substantially circular arc.

16. A machine according to claim 15, wherein said means for moving said second carriage relative to said first carriage includes at least one rack coupled to a piston-and-cylinder actuator, a pinion in meshing engagement with said rack, said pinion being fixed for rotation with a spindle, and a pin for coupling said spindle to said second carriage.

17. A machine according to claim 14, together with further restraining means engageable with an upper edge of the partition positioned at the rear of the advanced length of the flexible material U-shaped channel, said further restraining means includes a pivoted lever, said pivoted lever having at a rear end a claw, a piston-and-cylinder actuator for moving said pivoted lever between an active position in which said claw engages a marginal edge portion of said partition and a retracted position for releasing said partition, said rear end of said pivoted lever further including a ramp surface engageable with a cam attached to said folder blade, said cam being operative to cause said pivoted lever to be temporarily retracted on completion of the compressing of a centrally folded advanced length of the flexible material U-shaped channel.

18. A machine according to claim 1, wherein said restraining means includes restraining units disposed along the three sides of the flexible material U-shaped channel, each of said restraining units including a pivoted lever having at a rear end a claw for engagement with the centrally folded advanced length of the flexible material U-shaped channel, and a front end coupled to a return spring means, said lever having a retracted position in which said claw cooperates with said centrally folded advanced length of the flexible material U-shaped channel.

19. A machine according to claim 1, together with further restraining means engageable with an upper edge of the partition positioned at the rear of the advanced length of the flexible material U-shaped channel, said further restraining means including a pivoted lever, said pivoted lever having at a rear end thereof a claw, a piston-and-cylinder actuator for moving said pivoted lever between an active position in which said claw engages a marginal edge portion of said partition and a retracted position for releasing said partition.

20. A machine according to claim 1, wherein said means for braking the forward movement of the multiplicity of linked pockets comprises a pair of pressure rollers rotatable about vertical area and engageable with side edges of said multiplicity of pockets, and means for adjusting the distance between said rollers.

21. A machine according to claim 1, wherein said means for positioning a partition at the rear end of the advanced length of the flexible material U-shaped channel includes a plate movable between a substantially horizontal position for receiving a partition and a substantially vertical position for positioning said partition at the rear end of the advanced length of the flexible material U-shaped channel.

22. A machine according to claim 21, said means for positioning a partition at the rear end of the advanced length of the flexible material U-shaped channel further including a piston-and-cylinder actuator and a ramp surface for controlling the movement of said plate, and suction means on a surface of said plate for receiving said partion.

* * * * *

UNITED STATES PATENT AND TRADEMARK OFFICE

CERTIFICATE OF CORRECTION

PATENT NO. : 4,425,111

DATED : January 10, 1984

INVENTOR(S) : Andre Chazelas

It is certified that error appears in the above-identified patent and that said Letters Patent is hereby corrected as shown below: On the title page item [76] should read:

[76] Inventor: Andre Chazelas, deceased, late of Oinville, France, and by Marie Bornot, Daniel Chazelas and Gabrielle Sylviane Chazelas Derouetteau, guardian of Gilles Chazelas, all of which are rightful heirs in the Devolution of the Estate of Andre Chazelas in accordance with French law, all heirs residing in France.--.

Signed and Sealed this

*Eleventh* Day of *June 1985*

[SEAL]

*Attest:*

DONALD J. QUIGG

*Attesting Officer* *Acting Commissioner of Patents and Trademarks*